US006246035B1

(12) United States Patent
Okuda

(10) Patent No.: US 6,246,035 B1
(45) Date of Patent: Jun. 12, 2001

(54) HEATING DEVICE, IMAGE FORMING APPARATUS INCLUDING THE DEVICE AND INDUCTION HEATING MEMBER INCLUDED IN THE DEVICE

(75) Inventor: Kouichi Okuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/413,332

(22) Filed: Oct. 12, 1999

(30) Foreign Application Priority Data

Oct. 13, 1998 (JP) ..... 10-290817

(51) Int. Cl.[7] ..... H05B 6/14; G03G 15/20

(52) U.S. Cl. ..... 219/619; 219/216; 219/634; 399/330; 399/332

(58) Field of Search ..... 219/619, 634, 219/653, 659, 647, 649, 216; 399/330, 332, 336, 334, 335

(56) References Cited

U.S. PATENT DOCUMENTS

| | | | | |
|---|---|---|---|---|
| 5,182,606 | * | 1/1993 | Yamamoto et al. | 399/335 |
| 5,243,393 | * | 9/1993 | Menjo | 399/325 |
| 5,278,618 | | 1/1994 | Mitani et al. | 355/285 |
| 5,289,246 | * | 2/1994 | Menjo | 399/333 |
| 5,362,943 | * | 11/1994 | Sakata | 219/216 |
| 5,708,920 | * | 1/1998 | Ohnishi et al. | 399/69 |
| 5,745,833 | | 4/1998 | Abe et al. | 399/330 |
| 5,819,150 | | 10/1998 | Hayasaki et al. | 399/330 |
| 5,839,042 | * | 11/1998 | Tomatsu | 399/328 |
| 6,031,215 | * | 2/2000 | Nanataki et al. | 219/619 |
| 6,072,964 | * | 6/2000 | Abe et al. | 399/69 |

FOREIGN PATENT DOCUMENTS

| | | |
|---|---|---|
| 0 302 517 A2 | 2/1989 | (EP) . |
| 63-313182 | 12/1988 | (JP) . |
| 2-157878 | 6/1990 | (JP) . |
| 10-48868 | 2/1998 | (JP) . |

* cited by examiner

*Primary Examiner*—Tu Ba Hoang
(74) *Attorney, Agent, or Firm*—Fitzpatrick, Cella, Harper & Scinto

(57) ABSTRACT

A heating device suitable for use as a fixing means for fixing a toner image onto a recording medium in, e.g., an electrophotographic image forming apparatus is provided so as to provide images free from image blurring or fixing failure while improving the anti-offset performance. The heating device includes a heating member, and a heat-resistant film having a first surface to be moved relative to and in contact with the heating member and a second surface to be in contact with a member to be heated, so that the member to be heated and the heat-resistant film are moved together over the heating member to heat the member to be heated. The heat-resistant film comprises at least a base layer and an elastic layer, wherein the elastic layer contains a filler exhibiting a thermal conductivity of at least 0.04 cal/cm.sec. °C.

18 Claims, 6 Drawing Sheets

HEATING DEVICE, IMAGE FORMING APPARATUS INCLUDING THE DEVICE AND INDUCTION HEATING MEMBER INCLUDED IN THE DEVICE

FIELD OF THE INVENTION AND RELATED ART

The present invention relates to a heating device for imparting heat energy to a member to be heated, such as a recording sheet, an image forming apparatus using the heating device as a fixing means, and an induction heating member included in such a heating device.

Hitherto, as a fixing device for an image forming apparatus, such as a copying machine, a printer, an image-outputting apparatus for a facsimile apparatus, a hot roller-type fixing device has been popularly used. This type of fixing device basically comprises a metallic heating roller containing therein an internal heater, and an elastic pressure roller pressed against the heating roller so as to form a fixing nip therebetween, whereby a recording material carrying a toner image is passed through the fixing nip to fix the toner image under heating and pressure onto the recording material. In the hot roller-type device, the fixing roller generally has a large heat capacity, so that a very long time is required for raising the roller surface temperature up to the fixing temperature. For this reason, in order to quickly perform an image forming operation at a desired time, it is necessary to keep the roller surface temperature at a certain temperature even in the absence of the image forming operation.

A fixing system solving the above-mentioned problems of the hot roller fixing system has been proposed by our research and development group (Japanese Laid-Open Patent Application (JP-A) 63-313182 and JP-A 2-157878). The fixing device of this type (film heating-type fixing device) generally includes a thin heat-resistant film, a heater fixedly supported on one surface-side of the film, and a pressing film disposed on the other surface-side of the film and opposite to the heater so as to press a recording material subjected to image fixation against the heater via the film.

A fixing operation by the film heating-type fixing device is performed by passing a recording material through a fixing nip formed by pressing the pressing member against the heater via the film and heating the surface of the recording material carrying the toner image via the film to heat-melt and fix the toner image onto the recording medium. The fixing film used in the film heating-type fixing deice has comprised a 20 to 50 $\mu$m-thick film of a heat-resistant resin, such as polyimide, coated on its outer surface with a 5 to 20 $\mu$m-thick release layer of PTFE (polytetrafluoroethylene) or PFA (tetrafluoroethylene perfluoroalkyl vinyl ether copolymer).

In such a fixing device of the film heating-type, a heater of small heat capacity can be used so that it is possible to shorten the waiting time (i.e., effect a quick start), compared with the conventional hot roller scheme. Further, as the quick start is possible, preheating during a non-image forming operation period becomes unnecessary, so that overall power economization can be realized.

In the fixing system using such a fixing film, the occurrence of image irregularities, such as image aberration or blurring has been encountered in some cases. Particularly, in the case of fixing plural layers of different color toners in superposition, the overall toner layer becomes thick, so that the reproduced objective image is liable to be accompanied with image blurring of respective toner colors.

For obviating the problem, it has been proposed to coat the film surface with an elastic layer by our research and development group (JP-A 10-48868). This is effective for preventing image aberration or blurring by covering or wrapping the toner image with such a deformable elastic layer. On the other hand, the resultant thicker fixing film is liable to exhibit a worse fixing performance and is also liable to cause offsetting.

SUMMARY OF THE INVENTION

A generic object of the present invention is to solve the above-mentioned problems involved in the film heating-type fixing device.

A more specific object of the present invention is to provide a film heating device suitable for use as a fixing device for an image forming apparatus using a powdery toner, capable of obviating fixing failure and fixed image aberration or blurring.

Another object of the present invention is to provide a film heating device suitable for use as a fixing device for an image forming apparatus using a powdery toner, capable of exhibiting good fixing performance free from offsetting.

A further object of the present invention is to provide an image forming apparatus including such a heating device, and also an induction heating member included in such a heating device.

According to my further study, the difficulties, such as inferior fixing performance or offsetting, caused by the provision of an elastic layer effective for preventing image aberration or blurring are principally attributable to an increase in thickness of the fixing film due to provision of the elastic layer.

For example, the increased film thickness leads to a smaller capacitance, so that even an identical charge can result in an increased surface potential liable to cause offset phenomenon. According to my study, it has been found that these difficulties can be effectively obviated by inclusion of appropriate fillers in the elastic layer.

Thus, according to the present invention, there is provided a heating device, comprising: a heating member, and a heat-resistant film having a first surface to be moved relative to and in contact with the heating member and a second surface to be in contact with a member to be heated, so that the member to be heated and the heat-resistant film are moved together over the heating member to heat the member to be heated; wherein the heat-resistant film comprises at least a base layer for providing the first surface and an elastic layer on the other side of the heat-resistant film, the elastic layer containing a filler exhibiting a thermal conductivity of at least 0.04 cal/cm.sec. °C.

According to the present invention, there is also provided a heating device, comprising: an excitation coil, an induction heating member, and a pressing member pressed against the induction heating member to form a nip, so that a member to be heated is passed through the nip between the induction heating member and the pressing member to be heated, wherein the induction heating member comprises at least a heat-generating layer comprising a magnetic metal, and an elastic layer; the elastic layer containing a filler having a thermal conductivity of at least 0.04 cal/cm.sec. °C.

According to another aspect of the present invention, there is also provided an image forming apparatus including the above-mentioned heating device as a fixing device.

According to still another aspect of the present invention, there is provided an induction heating member, comprising a heat-generating layer comprising a magnetic metal, and an elastic layer; the elastic layer containing a filler having a thermal conductivity of at least 0.04 cal/cm.sec. °C.

Thus, in the heating device of the present invention, the elastic layer of the heat-resistant film is caused to contain filler particles exhibiting a high thermal conductivity, whereby heat for fixation is effectively conducted to the member to be heated, particularly a toner image on a recording member, thereby effectively fixing the toner image without causing image aberration or blurring. Further, by using thermally conductive particles also exhibiting a good electroconductivity or additionally including electroconductive particles, the electric charge accumulation on the elastic layer is effectively suppressed, and further an increased capacitance by inclusion of the electroconductive filler is effective for suppressing a surface potential caused by the surface charge on the heat-resistant film, whereby an electrostatic offset of the toner image on the member to be heated can be effectively prevented.

These and other objects, features and advantages of the present invention will become more apparent upon a consideration of the following description of the preferred embodiments of the present invention taken in conjunction with the accompanying drawings, wherein like parts are denoted by like reference numerals.

DETAILED DESCRIPTION OF THE INVENTION

The heating device according to the present invention is characterized by the use of a heating member including an elastic layer containing a filler having a high thermal conductivity of at least 0.04 cal/cm.sec. °C., so that the elastic layer can exhibit an improved thermal conductivity at a relatively small amount of the thermoconductive filler, while retaining a good elasticity of the elastic layer. More specifically, the elastic layer may preferably contain the thermoconductive filler at a concentration of at most 50 wt. % and at least 5 wt. % so as to attain the effect of addition thereof. The thermoconductive filler should be dispersed in the elastic layer as uniformly as possible.

Hereinbelow, some embodiments of the present invention are described with reference to the drawings.

Figure 1:
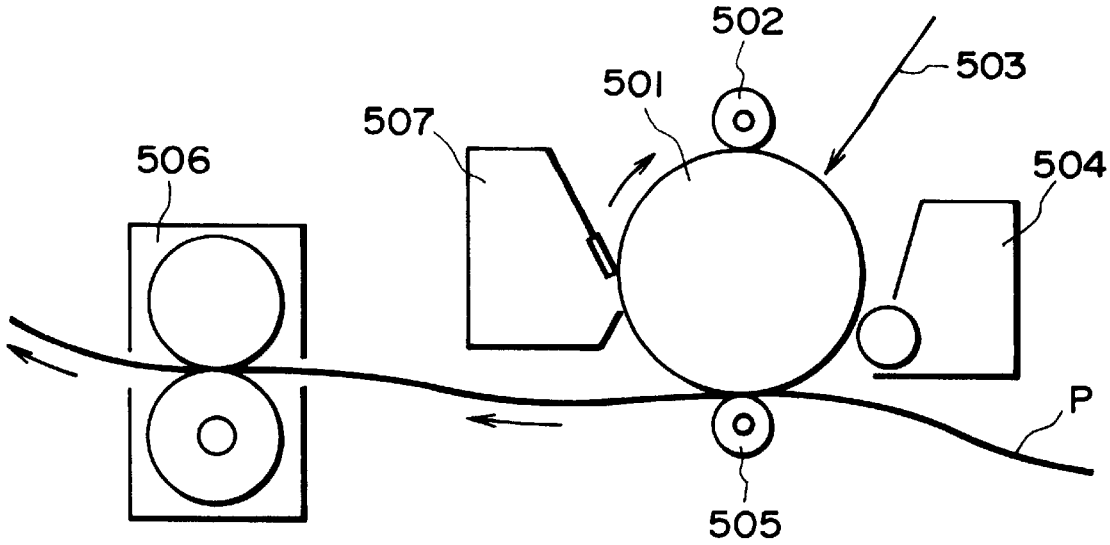
FIG. 1 is a schematic illustration of essential parts of an image forming apparatus including a heating device of the invention as a fixing device.

FIG. 1 is a schematic illustration of essential parts of an image forming apparatus using a powdery toner and including a heating device of the present invention as a fixing device.

Referring to FIG. 1, the image forming apparatus includes a photosensitive drum 501 which comprises a layer of photosensitive material, such as OPC (organic photoconductor), amorphous Se, or amorphous Si formed on a cylindrical substrate of aluminum or nickel. The photosensitive drum 501 is driven in rotation in an indicated arrow direction, and during its rotation, is first uniformly surface-charged by a charging roller 502 as a charging device. Then, the surface-charged photosensitive drum is exposed to scanning laser beam 503 controlled with respect to its ON/OFF state depending on given image data to have an electrostatic latent image thereon. The electrostatic image is developed for visualization by a developing device 504 to form a toner image thereon. The developing may be effected, e.g., by the jumping developing method, the two-component developing method or the FEED (flowing electrode effect development) method. The reversal development mode may preferably be used in combination with a laser beam exposure scheme.

The visualized toner image on the photosensitive drum 501 is transferred under the operation of a transfer roller 505 onto a recording material (or transfer material) P, such as paper, synchronously conveyed to a transfer position, i.e., a position of nip at a prescribed pressure between the drum 501 and the transfer roller 505. The recording material P carrying the thus-transferred toner image is then conveyed to a fixing device 506, where the toner image is fixed onto the recording material P as a permanent image. On the other hand, a residual portion of toner remaining on the photosensitive drum 501 is removed from the surface of the photosensitive drum 501 by a cleaning device 507. The thus-cleaned photosensitive drum 501 is then again subjected to a subsequent image forming cycle starting with uniform (primary) charging by the charger 502.

Figure 2:
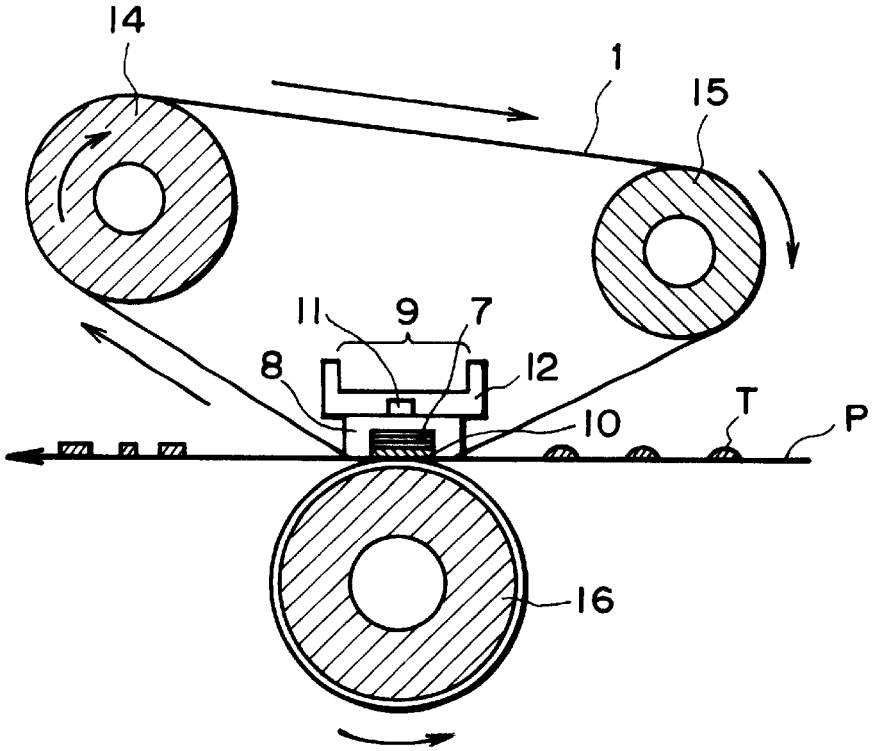
FIGS. 2 and 3 are sectional views of heat-fixing devices that are embodiments of the invention.

The fixing device 506 may have a detailed structure as shown in FIG. 2, a sectional view of an embodiment thereof. Referring to FIG. 2, the fixing device includes a heating member 9 having a thermoconductive substrate 8, a resistance layer 7 generating heat on current passage therethrough and a ca. 10 $\mu$m-thick insulating glass coating 10 on its film-rubbing surface. The heating member (heater) is further provided with a thermistor 11 and a heater-supporting member 12 for insulatively supporting the heater 9. The heating device (fixing device) further includes a heat-resistant film 1, a drive roller 14 for driving the heat-resistant film 1, a follower roller 15, and a pressing roller 16, respectively moving or rotating in an indicated arrow direction. A recording material P carrying a toner image T is passed through a nip between the pressing roller 16 and the heat-resistant film 1 heated by the heating member 9.

Figure 3:
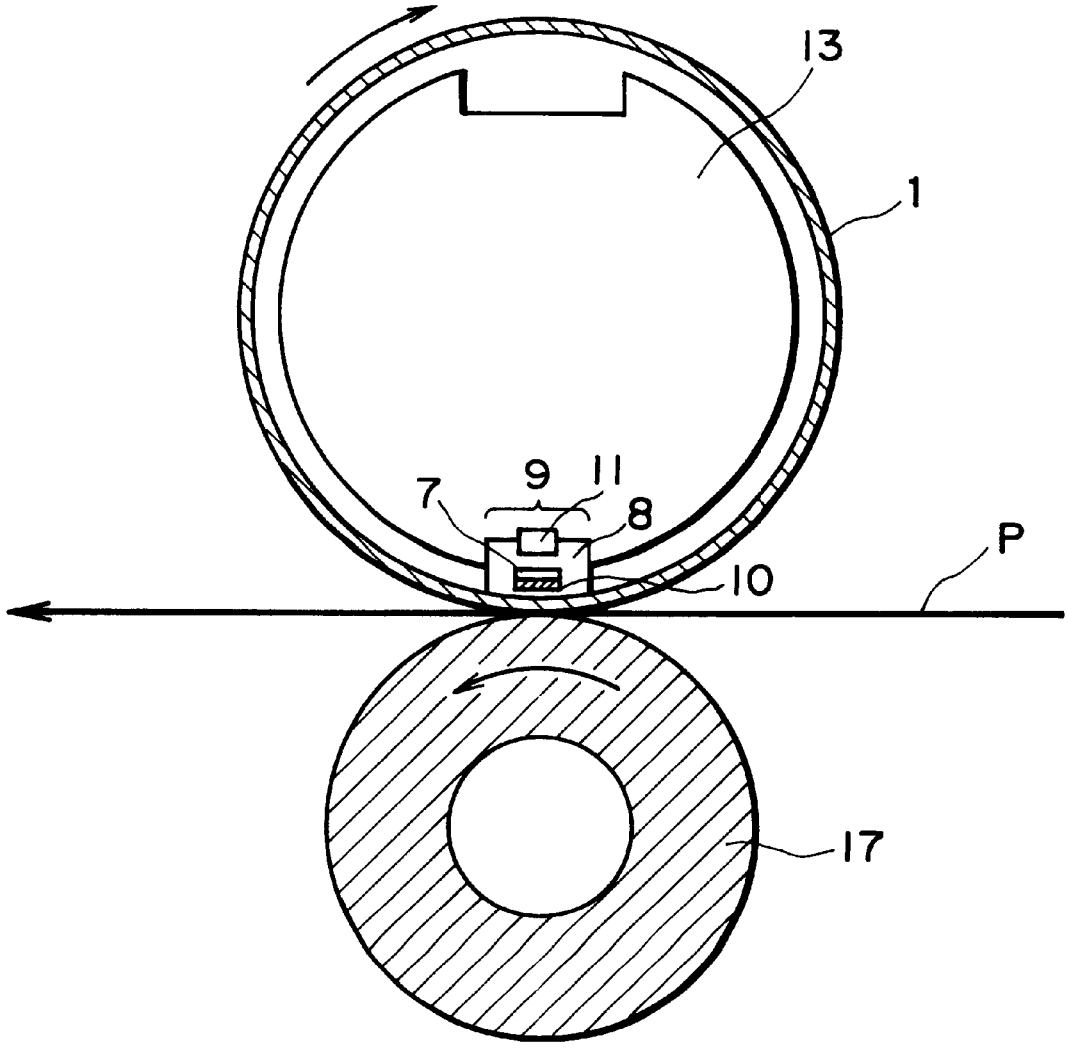

Another embodiment of the fixing device 506 may have a detailed structure as shown in a sectional view of FIG. 3.

In the fixing device of FIG. 3, a heat-resistant film 1 is disposed loosely around a stay 13 so as to be free from tension, and is driven by a pressure roller 17 also functioning as a film drive roller. The other members and structures are similar to corresponding members in the embodiment of FIG. 3.

Figure 4:
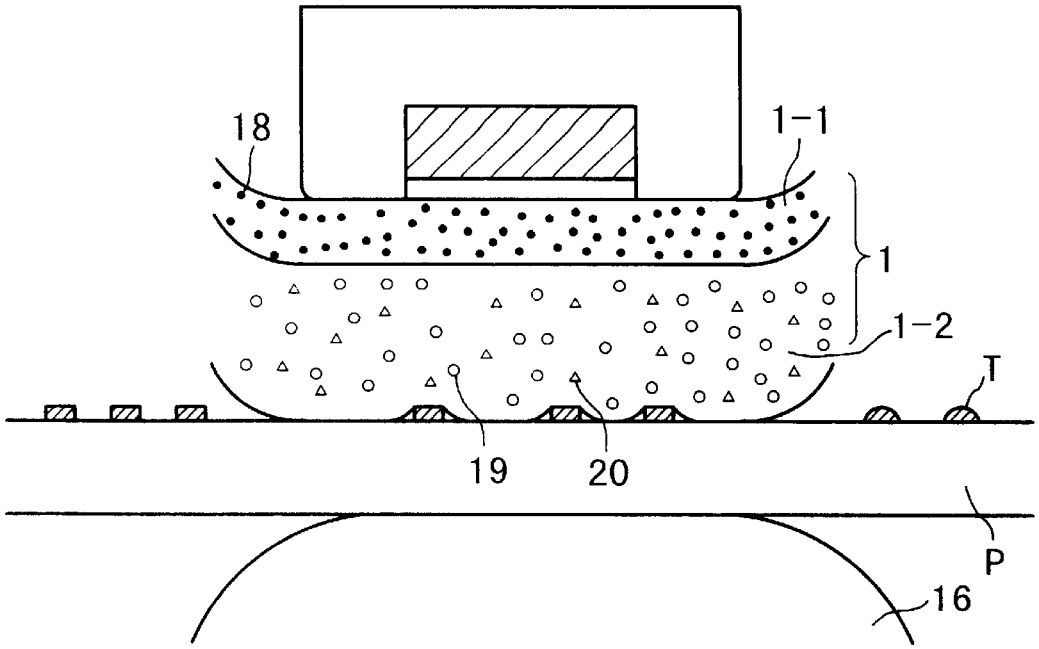
FIGS. 4 to 6 illustrate sectional views of embodiments of the fixing film (heating member) according to the invention in an operating state.

FIG. 4 is a sectional view illustrating an example of the sectional structure of such a heat-resistant film 1.

Referring to FIG. 4, the heat-resistant film 1 has a two-layer structure including a base layer 1-1 and an elastic layer 1-2. The base layer 1-1 comprises a heat-resistant resin, examples of which may include: polyimide resin, polyether sulfone resin, polyether ketone resin, polyether imide resin, polyamide imide resin, silicone resin, and fluorine-containing resin.

In addition to such heat-resistant resin, the base layer 1-1 may contain heat-conductive particles 18 dispersed therein, examples of which may include particles of silicon carbide (SiC), silicon nitride ($Si_3N_4$), boron nitride (BN), aluminum nitride (AlN), alumina ($Al_2O_3$), nickel, iron, and aluminum. These heat-conductive filler particles all exhibit a thermal conductivity of at least 0.04 cal/cm.sec. °C.

The heat-conductive particles may suitably have an average particle size (number average particle size, herein) of 0.1–20 μm, and may suitably be contained in a proportion of 0.5–8 wt. % of the base layer 1-1. These ranges are preferred so that they can be easily dispersed and enhanced thermal conductivity can be attained without impairing the strength of the resultant film. The thermal conductivity improving effect can be attained even at a small addition amount of the filler particles, and the addition in excessive amount thereof leads to a decrease in flexibility and a decrease in flexural strength of the resultant film.

For the film formation, care should be taken so as not to leave unevennesses on the (inner) surface of the base layer. The surface roughness Rz should preferably be suppressed to at most 10 μm so that the surface contacting and rubbing against the heater is smooth enough to decrease the friction between the film surface and the heater so as not to cause a performance lowering even in a long term of use.

The heat-conductive filler particles may preferably have a high volume resistivity of at least $10^4$ ohm.cm so as to prevent current leakage even when an excessive AC bias voltage is applied to the heater. In case of using a filler having a lower volume resistivity, it is necessary to decrease the filler content or provide a thicker glass-coating layer on the heater surface.

In this embodiment, the elastic layer is formed by dispersion in fluorine-containing rubber particles 20 of a fluorine-containing resin, such as PFA, PTFE or FEP (tetrafluoroethylene hexafluoropropylene copolymer), and particles 19 of a heat-conductive material having a thermal conductivity of at least 0.04 cal/cm.sec. ° C. Examples thereof may include: silicon carbide (SiC), silicon nitride ($Si_3N_4$), boron nitride (BN), aluminum nitride (AlN), alumina ($Al_2O_3$), Ni, Fe and Al. The heat-conductive particles 19 may preferably have an average particle size of 0.1–20 μm and be contained at a content of 5–50 wt. % in the elastic layer 1-2.

By using such a filler having a high thermal conductivity, it is possible to provide the elastic layer with an increased thermal conductivity at a small addition amount thereof, thereby improving the fixing performance. As a result, the hardness of the elastic layer can be kept low and is allowed to retain a good deformability thereof, whereby a yet unfixed toner image can be effectively wrapped by the elastic layer to prevent image aberration and image blurring.

On the other hand, if a filler having a low thermal conductivity is used, the addition amount thereof in the elastic layer has to be increased, whereby the elastic layer becomes rigid and hardly deformable, thus becoming less effective to prevent image aberration or blurring. The elastic layer should desirably retain a JIS A-hardness (JIS K6301) of at most 30 deg.

The thermal conductivity of a filler referred to herein is a value measured with respect to a filler material before pulverization thereof into filler particles. More specifically, a sintered filler material in the shape of a rectangular parallelepiped measuring 100 mm×50 m×20 mm was subjected to measurement at room temperature by using a heating filament-type thermal conductivity meter ("QTM-500" (trade name) equipped with a probe "PD11", mfd. by Kyoto Denshi Kogyo K.K.). The current supply to the heating filament was controlled by an automatic selection mode.

Thermal conductivity values thus measured with respect to some materials are listed in the following Table 1.

TABLE 1

| Thermal conductivities | |
|---|---|
| Material | cal/cm.sec. ° C. |
| $Al_2O_3$ | 0.04 |
| BN | 0.09 |
| SiC | 0.2 |
| $Si_3N_4$ | 0.07 |
| AlN | 0.3 |
| $SiO_2$ | 0.007 |
| $TiO_2$ | 0.008 |
| fluorine rubber | 0.0004 |
| silicone rubber | 0.0004 |
| polyimide resin | 0.0005 |

According to my experiment, with respect to heat-resistant films having the structure shown in FIG. 4, a heat-conductive filler 19 of BN could exhibit an identical fixing performance at a content which was ¼ or less of that of $SiO_2$ in the elastic layer 1-2.

EXAMPLE 1

A heat-resistant film 1 having a laminate structure as shown in FIG. 4 and an inner diameter of 24 mm was prepared in the following manner.

(Base layer 1-1)

To a varnish mixture of 360 wt. parts of a polyimide varnish ("Polyimide U-varnish-S" (trade name), mfd. by Ube-Kosan K.K.) and 40 wt. parts of a polyimide varnish ("Polyimide U-varnish-A" (trade name), mfd. by Ube-Kosan K.K.), BN (boron nitride) particles (Dav. (average particle size)=1.5 μm) ("UHP-S1" (trade name), mfd. by Showa Denko K.K.) were added to prepare a varnish mixture containing BN in an amount giving 15 wt. % of the varnish after curing.

Into the thus-prepared varnish mixture, a cylindrical metal mold having an outer diameter of 24 mm was dipped and then pulled up therefrom to have a varnish coating.

The coating on the cylinder mold was heat-treated successively at 120° C. for 40 min., at 200° C. for 20 min., at 220° C. for 40 min. and at 400° C. for 50 min. to complete the imidization reaction. After being cooled down to room temperature, the polyimide coating layer was separated from the cylindrical metal mold to provide a 50 μm-thick base layer 1-1.

(Elastic layer 1-2)

To 100 wt. parts of a fluorine rubber (vinylidene fluoride-hexafluoropropene tetrafluoroethylene terpolymer) latex ("Daiel Latex GL-152A", mfd. by Daikin Kogyo K.K.; rubber concentration of 43 wt. %), 82.7 wt. parts of a fluorine resin-dispersion liquid containing 52 wt. % of PFA ("Dispersion AD-1" (trade name), mfd. by Daikin Kogyo K.K.), and BN particles ("UHP-S1" above) in an amount of 10 wt. % of the total solid content was added thereto and sufficiently stirred to provide "A" liquid.

Separately, a mixture of 6 wt. parts of a polyamine vulcanizer ("Epomate F-100", mfd. by Yuka Shell K.K.) and 24 wt. parts of a silane coupling agent (mfd. by Nippon Unicar K.K.) was dissolved in 70 wt. parts of water to provide "B" liquid.

Then, the A liquid containing 100 wt. parts of the fluorine rubber was mixed with 15 wt. parts of the B liquid. The resultant mixture liquid was applied by spray coating onto the base layer 1-1, followed by preliminary drying at 80–100° C., and baking at 330° C. for 60 min. to form a 100 μm-thick fluorine rubber-based elastic layer containing 50 wt. % of fluorine resin and 10 wt. % of BN particles. The elastic layer was found to be coated with a ca. 1 μm-thick layer of fluorine resin surface layer due to partial precipitation at the surface of the fluorine resin during the baking.

The thus-prepared heat-resistant film 1 was incorporated in a fixing device having a structure as shown in FIG. 3, and the fixing device was incorporated as a fixing device in a commercially available color laser printer ("LBP-2030" (trade name), mfd. by Canon K.K.) and subjected to a printing performance test. For the test, the fixing device was operated at a process speed of 30 mm/sec, a heating member temperature of 190° C., a pressure roller total pressing force of 12 kg, a pressure roller outer diameter of 20 mm and a pressure roller surface rubber hardness of 48 deg. (Asker-C).

The printing test image was a lateral line image including plural lines each having a width of 7 dots at a resolution of 600 dpi, and lateral lines were printed by superposition of three color toners of yellow toner, magenta toner and cyan toner.

The resultant lateral lines were free from image aberration and no color blurring was observed at the contour of lateral lines. Further, no ghost line images were observed on a subsequent blank image portion of recording paper, attributable to offsetting of toner particles once attached onto the heat-resistant film and re-transferred to the blank image portion of the recording paper during a subsequent rotation of the film.

Similar results were obtained for heat-resistant films prepared by using particles each having an average particle size of 1.5 μm of $Al_2O_3$, SiC, $Si_3N_4$ and AlN, respectively, instead of BN particles in the elastic layer 1-2 in the above-mentioned printing performance test.

COMPARATIVE EXAMPLE 1

Heat-resistant films were prepared in the same manner as in Example 1 except for using $SiO_2$ particles (Dav.=1.2 μm) and $TiO_2$ particles (Dav.=2.0 μm), respectively, instead of BN particles in the elastic layer, and subjected to the same printing performance test as in Example 1.

As a result, both the heat-resistant films prepared by using $SiO_2$ particles and $TiO_2$ particles failed in sufficient fixation of the lateral line images, and the fixed toner images could be peeled off by rubbing with fingers.

The fixing performances were improved when the contents of $SiO_2$ and $TiO_2$ in the fluorine rubber elastic layer were increased to 40 wt. %, respectively, but in these cases, blurring of colors occurred at the contours of lateral line images.

EXAMPLE 2

Figure 5:
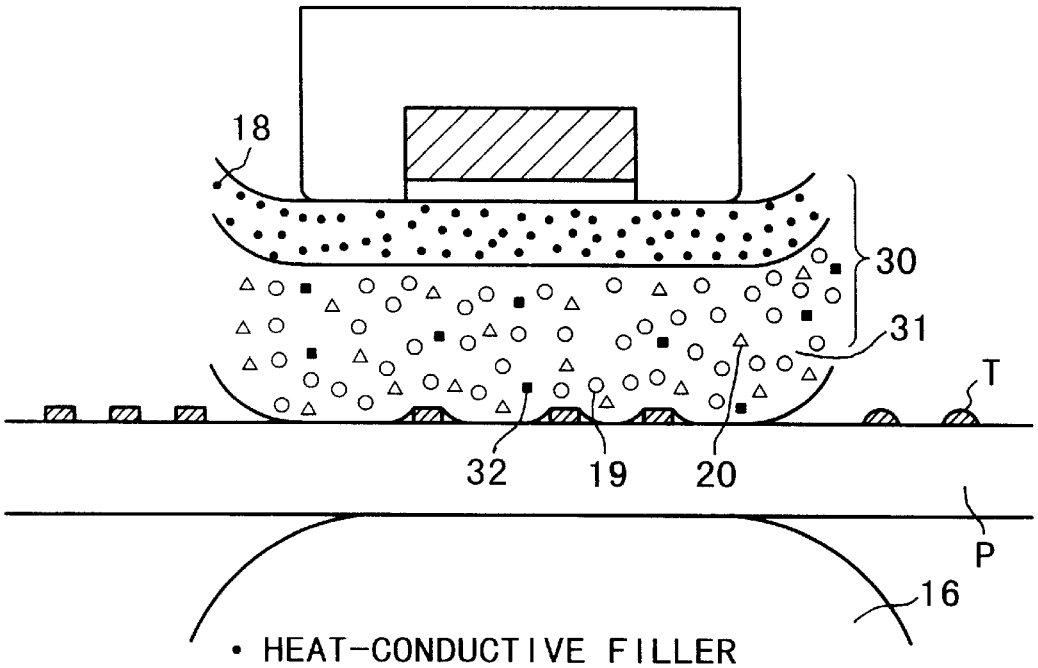

A heating-resistant film 30 adopted in this embodiment has an organization as illustrated in the schematic sectional view of FIG. 5. Referring to FIG. 5, the heat-resistant film according to this embodiment includes an elastic layer 31 which contains fluorine resin particles 20 and heat-conductive filler particles 19 (similar to the elastic layer 1-2 in the embodiment of FIG. 4) and further contains electroconductive filler particles 32, such as carbon, so as to obviate image failure due to electrostatic offset liable to be caused by charging of the film. The electroconductive filler particles 32 may preferably have a volume resistivity of at most 500 ohm·cm. The values of volume resistivity referred to herein are based on values measured by placing 10 g of an electroconductive filler sample within a 100 mm-long cylinder having an inner surface coated with polytetrafluoroethylene to have an inner diameter of 25 mm and between an upper electrode and a lower electrode in the cylinder and applying a voltage of 100 volts to the filler sample between the electrodes under a pressure of 10 kg/cm$^2$.

EXAMPLE 3

As shown in Example 2 mentioned above, it becomes possible to obviate image failure due to electrostatic offset caused by charging of the film by further incorporating an electroconductive filler in an elastic layer 31 as shown in FIG. 5. In the case of incorporating carbon for preventing the charging of the film, however, a large amount of carbon has to be incorporated in order to provide a sufficiently low-resistivity. This, however, results in increased hardness of the elastic layer, so that the resistivity of the elastic layer cannot be sufficiently lowered by the inclusion of carbon alone. Accordingly, in this embodiment, an electroconductive filler 32 of FIG. 5 is provided as whisker or short fiber of $K_2O.nTiO_2$ (potassium titanate), $9Al_2O_3.2B_2O_3$ (aluminum borate), $Si_3N_4$, SiC, alumina or glass, or metal whisker or graphite short fiber. The inclusion of such an electroconductive filler can lower the resistivity of the elastic layer at a small addition amount level, thus being able to obviate image failure due to electrostatic offset caused by charging of the film. Further, the hardness of the elastic layer can be kept low, so that image aberration and blurring can be effectively suppressed.

The whisker or short fiber may preferably have a diameter of at most 15 μm and a length of 5–1000 μm.

EXAMPLE 4

In the embodiment of Example 1 above, the elastic layer 1-2 of FIG. 4 was prepared by dispersing, in the fluorine rubber, particles 20 of fluorine resin, such as PFA, PTFE or FEP, and further particles 19 of a heat-conductive material, such as silicon carbide (SiC), silicon nitride ($Si_3N_4$), boron nitride (BN), aluminum nitride (AlN), alumina ($Al_2O_3$), Ni, Fe or Al. In this embodiment, these heat-conductive particles are included in the elastic layer after being made electroconductive by metal deposition thereon. As a result, the heat-conductive particles can also function as electroconductive particles whereby the resistivity of the elastic layer can be effectively lowered without using additional electroconductive particles, thus at a lower total filler content and at a lower elastic layer hardness.

EXAMPLE 5

Figure 6:
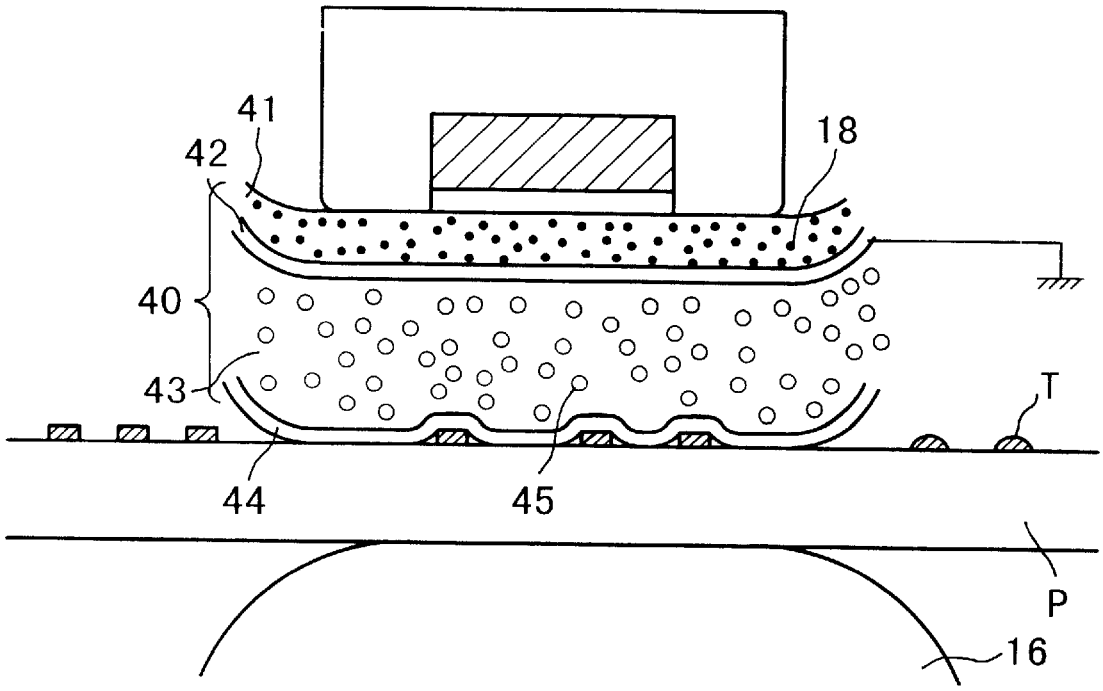

A heat-resistant film 40 of this embodiment has a four-layer structure as shown in FIG. 6.

More specifically, the heat-resistant film 40 has a base layer 41 comprising a 30 to 100 μm-thick polyimide resin layer containing heat-conductive particles 18 dispersed therein.

The base layer 41 is coated with an electroconductive primer layer 42 which has a thickness of at most 10 μm and is grounded with grounding means (not specifically shown).

The primer layer 42 is further coated with an elastic layer 43 which comprises a fluorine rubber or a silicone rubber with electroconductive and heat-conductive particles 45 dispersed therein and has a thickness of from 30 to 500 μm.

The elastic layer 43 is further coated with a 1 to 50 μm-thick surface layer 44 comprising a fluorine resin, such as PFA, PTFE or FEP and containing a small amount of electroconductive filler, such as carbon.

In this embodiment, a triboelectric or electrostatic charge generated on the film surface is removed through the path of the surface layer→elastic layer→electroconductive primer layer→ground. The electroconductive primer layer 42 functions to shorten the path of charge migration within the elastomer to effectively prevent offsetting.

Surface charge can be removed to some extent through pinholes, etc., from the surface layer, so that the electroconductive filler can be omitted from the surface layer.

Further, the enhanced removal of surface charge by inclusion of an electroconductive filler in the surface layer can also be obviated in the case of applying to the electroconductive primer layer 42 a voltage of polarity opposite to the toner charge so as to prevent offsetting or grounding the electroconductive primer layer 42 via a rectifier device, such as a diode. However, the lower resistivity of the elastic layer provides an enhanced electric field across the nip, so that an enhanced offset prevention effect can be attained by inclusion of an electroconductive filler.

EXAMPLE 6

Figure 7:
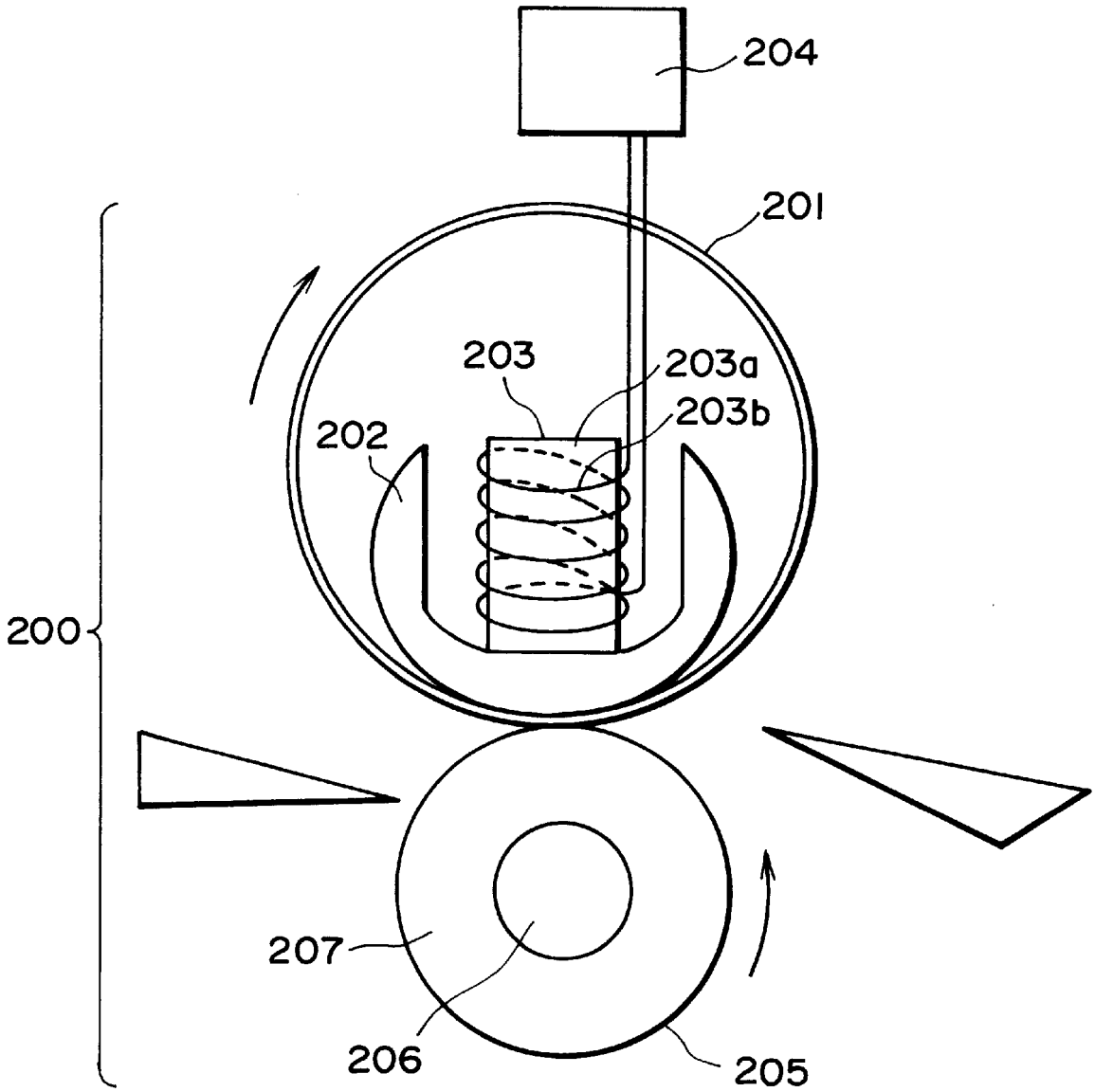
FIG. 7 is a side sectional view of an embodiment of the induction heating device according to the present invention.

FIG. 7 is a schematic sectional view of a heat-fixing device 200 according to this embodiment of the present invention.

Referring to FIG. 7, a fixing film 201 as a heating member is loosely fitted about a stay 202 comprising a liquid crystal polymer, phenolic resin, etc., and is pressed against the stay 202 at a prescribed pressure by a pressing roller 205.

The pressing roller 205 comprises a metal core 206 and an elastic layer 207 formed around the metal core of a heat-resistant rubber comprising silicone rubber, fluorine rubber, foamed silicone rubber, etc., optionally further coated with a release layer of PFA, PTFE, FEP, etc. The pressing roller 205 is rotated in an indicated arrow direction by a rotation drive mechanism (not shown) disposed at a longitudinal end thereof via the metal core 206. As a result, the fixing film 201 is rotated about the stay 202, following the rotation of the pressing roller 205.

Inside the fixing film 201 is disposed an excitation coil 203 which comprises a core 203*a* of a ferromagnetic material, such as ferrite, and a wire 203*b* wound about the core 203*a* and is supplied with a current from a power supply 204 including an oscillating circuit of a variable frequency disposed at a longitudinal end thereof. In this embodiment, the excitation coil core 203*a* is in the shape of the letter "U" so as to form a closed magnetic loop.

An alternating magnetic field is developed by supplying a high-frequency AC current of 10 kHz–1MHz, preferably 20 kHz–800 kHz, to the excitation coil 203 from the AC supply 204.

Figure 8:
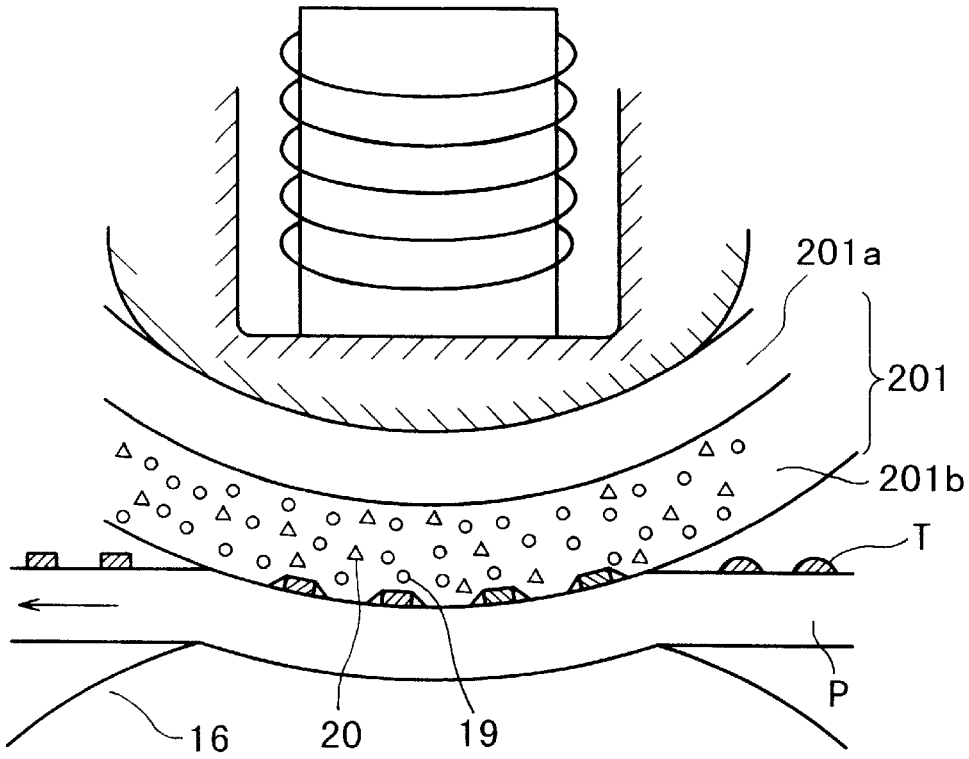
FIGS. 8 and 9 illustrate sectional views of embodiments of the induction heating member included in the heating device of FIG. 7 in an operating state.

The fixing film 201 adopted in this embodiment has a two-layer structure as shown in the sectional view of FIG. 8 including a 10 to 150 μm-thick base layer 201*a* of a magnetic metal or alloy of, e.g., Fe or Ni, and an elastic layer 201*b* formed on the base layer 201*a*.

An eddy current is generated in the base layer 201*a* under the alternating magnetic field caused by the excitation coil, whereby Joule heat is generated to heat a toner image carried on a recording medium conveyed to the fixing nip, thus heat-fixing the toner image onto the recording medium.

The temperature of the fixing film 201 is detected by a temperature detection means (not shown), and temperature data therefrom is sent via an A/D converter to a CPU. Based on the temperature data, the CPU changes the frequency of the AC power supply 204 to change the magnetic field intensity caused by the coil 203, thereby adjusting the heat quantity generated in the fixing film 201 to control the fixing film 201 at a prescribed temperature.

The elastic layer 201*b* in this embodiment is formed by dispersing, in a fluorine rubber, particles 20 of a fluorine resin, such as PFA, PTFE or FEP and further heat-conductive particles 19 of ceramic powder, metal oxide powder, metal powder, etc. More specifically, the heat-conductive particles are particles of a heat-conductive material having a thermal conductivity of at least 0.04 cal/cm.sec. °C., such as particles of silicon carbide (SiC), silicon nitride ($Si_3N_4$), boron nitride (BN), aluminum nitride (AlN), alumina ($A1_2O_3$), Ni, Fe, Al, etc. The heat-conductive particles may preferably have an average particle size of at most 20 μm and be contained in a proportion of at most 50 wt. % in the elastic layer 201*b*.

As has been discussed with reference to the above embodiments, by using such a filler having a high thermal conductivity, it is possible to provide the elastic layer with increased thermal conductivity at a small addition amount thereof, thereby improving the fixing performance. As a result, the hardness of the elastic layer can be kept low and is allowed to retain a good deformability thereof, whereby a yet unfixed toner image can be effectively wrapped by the elastic layer to prevent image aberration and image blurring.

On the other hand, if a filler having a low thermal conductivity is used, the addition amount thereof in the elastic layer has to be increased, whereby the elastic layer becomes rigid and hardly deformable, thus becoming less effective to prevent the image aberration or blurring.

EXAMPLE 7

Figure 9:
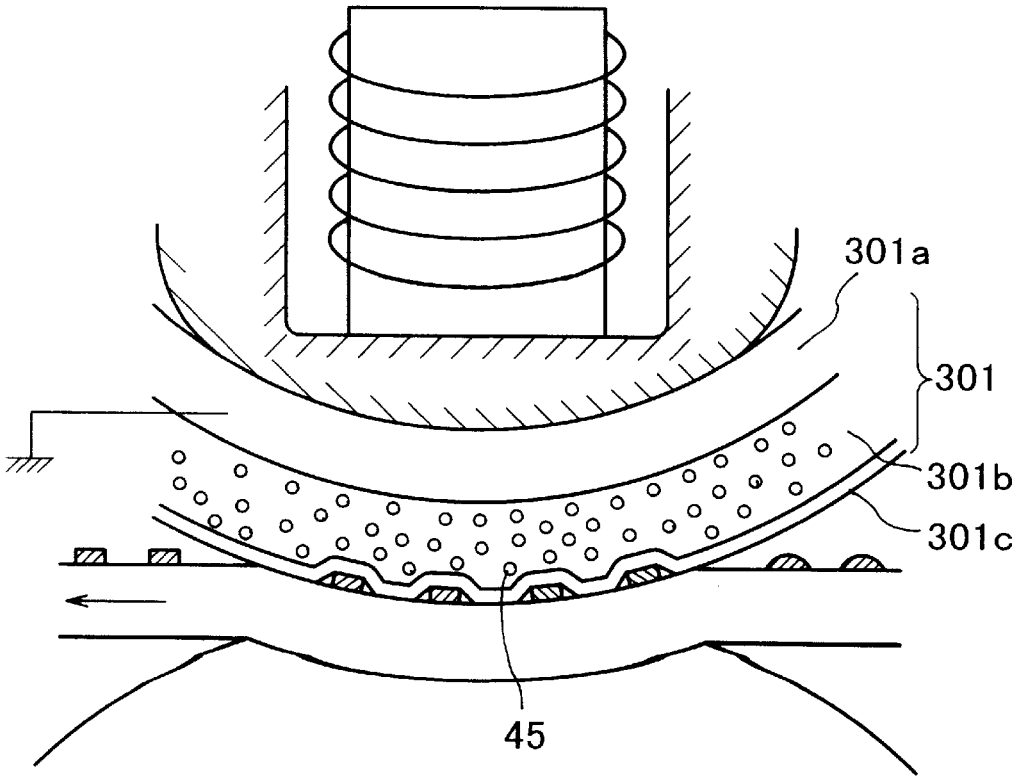

A heat-resistant film 301 of this embodiment has a three-layer structure as shown in FIG. 9.

More specifically, the heat-resistant film 301 includes a 10 to 150 μm-thick base layer 301*a* of a magnetic metal or alloy of, e.g., Fe or Ni, which is grounded with grounding means (not specifically shown). The base layer 301*a* is coated with an elastic layer 301*b* which comprises a fluorine rubber or a silicone rubber with electroconductive and heat-conductive particles 45 dispersed therein and has a thickness of from 30 to 500 μm.

The elastic layer 301*b* is further coated with a 1 to 50 μm-thick surface layer 301*c* comprising a fluorine resin, such as PFA, PTFE or FEP and containing a small amount of electroconductive filler, such as carbon.

In this embodiment, a triboelectric or electrostatic charge generated on the film surface is removed through the path of the surface layer→elastic layer→electroconductive base layer→ground. The electroconductive base layer 301*a* functions to shorten the path of charge migration within the elastomer to effectively prevent offsetting.

Surface charge can be removed to some extent through pinholes, etc., from the surface layer 301*c*, so that the electroconductive filler can be omitted from the surface layer.

Further, the enhanced removal of surface charge by inclusion of an electroconductive filler in the surface layer can also be obviated in the case of applying to the electroconductive base layer 301*a* a voltage of polarity opposite to the toner charge so as to prevent offsetting or grounding the electroconductive base layer 301*a* via a rectifier device, such as a diode.

In a specific example, a heat-resistant film 301 according to this embodiment was prepared in the following manner.

(Base layer 301*a*)

A 150 μm-thick endless Ni film having an inner diameter of 30 mm was prepared by electroforming.

(Elastic layer 301*b*)

To 100 wt. parts of a fluorine rubber (vinylidene fluoride-hexafluoropropene tetrafluoroethylene terpolymer) latex ("Daiel Latex GL-152A", mfd. by Daikin Kogyo K.K.; rubber concentration of 43 wt. %), 8.3 wt. parts of a fluorine resin-dispersion liquid containing 52 wt. % of PFA ("Dispersion AD-1" (trade name), mfd. by Daikin Kogyo K.K.), and BN particles ("UHP-S1") in an amount of 10 wt. % of the total solid content was added thereto and sufficiently stirred to provide "A" liquid.

Separately, a mixture of 6 wt. parts of a polyamine vulcanizer ("Epomate F-100", mfd. by Yuka Shell K.K.) and 24 wt. parts of a silane coupling agent (mfd. by Nippon Unicar K.K.) was dissolved in 70 wt. parts of water to provide "B" liquid.

Then, the A liquid containing 100 wt. parts of the fluorine rubber was mixed with 15 wt. parts of the B liquid. The resultant mixture liquid was applied by spray coating onto the base layer 301*a*, followed by preliminary drying at 80–100° C., and baking at 330° C. for 30 min. to form a 100 μm-thick fluorine rubber-based elastic layer containing 5 wt. % of fluorine resin and 10 wt. % of BN particles.

(Surface layer 301*c*)

The fluorine resin-dispersion liquid ("Dispersion AD-1") used in forming the elastic layer 301*b* was again applied by spraying onto the layer 301*b*, followed by preliminary drying at 80–100° C. and baking at 330° C. for 30 min. to form a 10 μm-thick fluorine resin surface layer 301*c*.

The thus-prepared heat-resistant film 301 was incorporated as a fixing film 201 in a fixing device having a structure as shown in FIG. 7, and the fixing device was incorporated as a fixing device in a commercially available color laser printer ("LBP-2030" (trade name), mfd. by Canon K.K.) and subjected to a printing performance test. For the test, the fixing device was operated at a process speed of 60 mm/sec, a base layer temperature of 150° C. in the fixing film, a pressure roller total pressing force of 30 kg, a pressure roller outer diameter of 30 mm and a pressure roller surface rubber hardness of 45 deg.

(Asker-C).

The printing test image was a lateral line image including plural lines each having a width of 7 dots at a resolution of 600 dpi, and lateral lines were printed by superposition of three color toners of yellow toner, magenta toner and cyan toner.

The resultant lateral line images were free from image aberration and no color blurring was observed at the contour of lateral line images. Further, no ghost line images were observed on a subsequent blank image portion of recording paper, attributable to offsetting of toner particles once attached onto the heat-resistant film and re-transferred to the blank image portion of the recording paper during a subsequent rotation of the film.

Similar results were obtained for heat-resistant films prepared by using particles (each of Dav.=1.5 μm) of $Al_2O_3$, SiC, $Si_3N_4$ and AlN, respectively, instead of BN particles in the elastic layer 1-2 in the above-mentioned printing performance test.

COMPARATIVE EXAMPLE 2

Heat-resistant films were prepared in the same manner as in Example 7 except for using $SiO_2$ particles (Dav.=1.2 μm) and $TiO_2$ particles (Dav.=2.0 μm), respectively, instead of BN particles in the elastic layer, and subjected to the same printing performance test as in Example 7.

As a result, both the heat-resistant films prepared by using $SiO_2$ particles and $TiO_2$ particles failed in sufficient fixation of the lateral line images, and the fixed toner images could be peeled off by rubbing with fingers.

The fixing performances were improved when the contents of $SiO_2$ and $TiO_2$ in the fluorine rubber elastic layer were increased to 40 wt. %, respectively, but in these cases, blurring of colors occurred at the contours of lateral line images.

What I claimed is:

1. A heating device, comprising: a heating member, and a heat-resistant film having a first surface to be moved relative to and in contact with the heating member and a second surface to be in contact with a member to be heated, so that the member to be heated and the heat-resistant film are moved together over the heating member to heat the member to be heated; wherein the heat-resistant film comprises at least a base layer and an elastic layer, the elastic layer containing a filler exhibiting a thermal conductivity of at least 0.04 cal/cm.sec. °C.

2. A heating device according to claim 1, wherein the filler is contained in an amount of 5–50 wt. % in the elastic layer.

3. A heating device according to claim 1, wherein the filler comprises particles of a material selected from the group consisting of ceramic materials, metal oxides and metals.

4. A heating device according to claim 1, wherein the filler comprises particles of a material selected from the group consisting of silicon carbide, silicon nitride, boron nitride, aluminum nitride, alumina, Ni, Fe and Al.

5. A heating device according to claim 1, wherein the elastic layer contains an electroconductive filler.

6. A heating device according to claim 1, wherein the elastic layer further contains fluorine resin particles.

7. A heating device according to claim 1, wherein the elastic layer is coated with a surface layer.

8. A heating device according to claim 7, wherein the surface layer comprises a fluorine resin.

9. A heating device according to claim 1, wherein the elastic layer comprises a fluorine rubber and the filler is dispersed in the fluorine rubber.

10. A heating device according to claim 1, wherein the elastic layer has a thickness of 30–500 μm.

11. A heating device, comprising: an excitation coil, an induction heating member, and a pressing member pressed against the induction heating member to form a nip, so that a member to be heated is passed through the nip between the induction heating member and the pressing member to be heated, wherein the induction heating member comprises at least a heat-generating layer comprising a magnetic metal, and an elastic layer; the elastic layer containing a filler having a thermal conductivity of at least 0.04 cal/cm.sec. °C.

12. A heating device according to claim 11, wherein the filler is contained in an amount of 5–50 wt. % in the elastic layer.

13. A heating device according to claim 11, wherein the elastic layer has a thickness of 30–500 μm.

14. A heating device according to claim 11, wherein the elastic layer is coated with a layer of fluorine resin.

15. An image forming apparatus, including a heating device according to any one of claims 1–14 as a fixing means.

16. An induction heating member, comprising a heat-generating layer comprising a magnetic metal, and an elastic layer; the elastic layer containing a filler having a thermal conductivity of at least 0.04 cal/cm.sec. °C.

17. An induction heating member according to claim 16, wherein the elastic layer comprises a fluorine rubber and the filler is dispersed in the fluorine rubber.

18. An induction heating member according to claim 16, wherein the elastic layer is further coated with a layer of fluorine resin.

* * * * *

UNITED STATES PATENT AND TRADEMARK OFFICE

CERTIFICATE OF CORRECTION

PATENT NO. : 6,246,035 B1
DATED : June 12, 2001
INVENTOR(S) : Kouichi Okuda

It is certified that error appears in the above-identified patent and that said Letters Patent is hereby corrected as shown below:

Column 1
Line 46, “deice” should read -- device --.

Column 12,
Line 6, “claimed” should read -- claim --.

Signed and Sealed this

Twenty-first Day of January, 2003

JAMES E. ROGAN
*Director of the United States Patent and Trademark Office*